US007578503B2

(12) United States Patent
McLaughlin et al.

(10) Patent No.: US 7,578,503 B2
(45) Date of Patent: Aug. 25, 2009

(54) VARIABLE PRESSURE BELT DRIVEN SHEET REGISTRATION SYSTEM

(75) Inventors: Matthew R. McLaughlin, Rochester, NY (US); Dennis N. Muck, Penfield, NY (US); David R. Kretschmann, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 288 days.

(21) Appl. No.: 11/525,146

(22) Filed: Sep. 21, 2006

(65) Prior Publication Data

US 2008/0073829 A1 Mar. 27, 2008

(51) Int. Cl.
*B65H 9/00* (2006.01)

(52) U.S. Cl. ..... 271/226; 271/225; 271/227

(58) Field of Classification Search ..... 271/4.05, 271/4.08, 225, 226, 227, 228
See application file for complete search history.

(56) References Cited

U.S. PATENT DOCUMENTS

| | | | | |
|---|---|---|---|---|
| 2,922,643 | A * | 1/1960 | Lopez | 271/35 |
| 3,970,298 | A * | 7/1976 | Irvine et al. | 271/34 |
| 4,159,782 | A * | 7/1979 | Swartzendruber | 221/1 |
| 4,919,411 | A * | 4/1990 | Ceelen | 271/35 |
| 5,129,642 | A * | 7/1992 | Svyatsky et al. | 271/10.03 |
| 5,678,159 | A | 10/1997 | Williams et al. | |
| 5,715,514 | A | 2/1998 | Williams et al. | |
| 6,173,952 | B1 | 1/2001 | Richards et al. | |
| 6,276,679 | B1 * | 8/2001 | Joyce et al. | 271/122 |
| 6,425,578 | B1 * | 7/2002 | Wood et al. | 271/37 |
| 2006/0211347 | A1 * | 9/2006 | Wall et al. | 451/355 |
| 2008/0061499 | A1 * | 3/2008 | DeGruchy et al. | 271/273 |

FOREIGN PATENT DOCUMENTS

| | | | |
|---|---|---|---|
| DE | 4432124 | A1 * | 3/1996 |
| JP | 05186068 | A * | 7/1993 |
| JP | 05208733 | A * | 8/1993 |

* cited by examiner

*Primary Examiner*—Patrick H Mackey
*Assistant Examiner*—Howard Sanders
(74) *Attorney, Agent, or Firm*—Luis M. Ortiz; Kermit D. Lopez; Tuesday A. Kaasch

(57) ABSTRACT

A sheet registration system for a sheet handling device has a plurality of driven belts. Each belt is entrained about a driven roller and an idler roller. The driven rollers are fixedly mounted on a common drive shaft that is connected to a motor. The idler rollers each have a shaft and the idler shafts are coaxially aligned and parallel to the common drive shaft. Adjacent idler shafts are interconnected. The idler rollers are cantilevered about the common drive shaft and may be pivoted thereabout. The gravitational force on the cantilevered idler rollers provide the normal pressure on the belts to produce the frictional force necessary to acquire and register incoming sheets. Selective pivoting of the idler rollers in response to sheet media parameters inputted to a control panel by an end user automatically varies the normal pressure of the idler rollers and adjusts the frictional force of the belts.

18 Claims, 5 Drawing Sheets

VARIABLE PRESSURE BELT DRIVEN SHEET REGISTRATION SYSTEM

BACKGROUND

An exemplary embodiment of this application relates to a variable pressure, belt driven sheet registration system for a sheet handling device. More particularly, the exemplary embodiment relates to a sheet edge registration system having a series of parallel driven belts. Each driven belt has a driven roller and an idler roller. The driven rollers are fixed to a common drive shaft and rotated thereby. The idler rollers each have an independent idler shaft about which the idler rollers may rotate, and the idler shafts are coaxially aligned and parallel to the common drive shaft of the driven rollers. Adjacent idler shafts are flexibly interconnected. A compression spring for each idler roller keeps the belts tensioned. The idler rollers and belts there around are cantilevered from the common drive shaft and may be pivoted there about. Thus, the gravitational force on the idler rollers and driven belts traveling around the idler rollers provide the necessary pressure or frictional acquiring force to register incoming sheets from a sheet transport. Selective pivoting of the idler rollers about the common drive shaft, in response to sheet media parameters that an end user inputs into the control panel of the sheet handling device, automatically varies the acquiring pressure applied by the belts on the incoming sheets to be registered.

Sheet handling devices may include document creating apparatus as well as finishing devices. In document creating apparatus, such as, for example, xerographic copiers and printers, it is increasingly important to be able to provide faster yet more accurate and reliable handling of a wide variety of image bearing sheets. Typically, the sheets are paper or plastic transparencies of various sizes, weights, and surfaces and may be subject to varying environmental conditions, such as humidity. Elimination of sheet misregistration at, for example, an imaging station of a copier or printer, is very important for proper imaging. In addition, sheet misregistration can adversely affect sheet feeding and ejection, as well as stacking and finishing of the sheets in a finishing device. While many document creating apparatus and finishing devices have adequate sheet registration systems, as delineated in the prior art listed below, none have an actively variable pressure sheet registration system that enables registration of a much broader range of acceptable sheet media having various weights, sizes, and coatings.

Sheet transporting devices are known to have driving nips that are typically designed to provide a normal force on the paper being transported therethrough that is sufficient to provide drive forces for sheets with particular media parameters without marking the sheet. However, as substrate or sheet mass increases, the potential for slip increases as well. Normal forces in the driving nip can be increased to offset this, but the potential for marking the lighter weight paper also increases. Thus, it is the aim of the exemplary embodiment of this application to provide automatic adjustment of the pressure or normal force of the driving nip of a registration system, in order to accommodate registration of a wide variety of sheet media.

U.S. Pat. Nos. 5,678,159 and 5,715,514 disclose dual differentially driven nips for automatic deskewing and side registration of sheets to be imaged in a printer, including the appropriate controls of the differentially driven sheet steering nips and including cooperative arrayed sheet edge position detector sensors and signal generators. As described therein, by driving two spaced apart steering nips with a speed differential to partially rotate a sheet for a brief period of time concurrently as the sheet is being driven forward by both nips, the sheet is briefly driven forward at an angle. Then the relative difference in the nip drive velocities is reversed to side shift the sheet into a desired lateral registration position as well as correcting any skew of the sheet as it entered the steering nips. Thus, the sheet exits the steering nips aligned in the process direction as well as being side registered.

U.S. Pat. No. 6,173,952 discloses a sheet handling system for correcting the skew and/or transverse position of sequential sheets moving in a process direction in a sheet transport path of a reproducing apparatus to be registered for image printing. The deskewing and/or side registration is accomplished by partially rotating the sheet with a transversely spaced pair of differentially driven sheet steering nips. The range of sheet size capabilities of this system may be increased without steering nip slippage or other problems by applying a control signal proportional to the width of the sheet to the system for automatically increasing or decreasing the transverse spacing between the pair of sheet steering nips. This is accomplished by automatically engaging only a selected pair of steering nips out of a plurality of different fixed position sheet steering nips and disengaging the others by lifting their idlers out of the sheet path with cams rotated by a stepper motor. The rotation of the cams by the stepper motor is controlled by the sheet width signal.

SUMMARY

According to aspects illustrated herein, there is provided a variable pressure, belt-driven sheet registration system for use in a sheet handling device, comprising: a series of driven parallel belts, each belt being mounted on a drive roller and an idler roller, said drive rollers being fixedly mounted on a common drive shaft for rotation thereby, said idler rollers being rotatably mounted on separate idler shafts that are coaxially aligned and parallel to said common drive shaft, adjacent idler shafts being flexibly interconnected; said idler rollers and driven belts thereon being cantilevered from and pivoted about said common drive shaft, so that gravitational force on said idler rollers provide pressure on said driven belts that contact incoming sheets to be registered thereby, thus generating a frictional force by said driven belts to enable said driven belts to register said incoming sheets against a wall; a first stepper motor being connected to said common drive shaft for rotation thereof; at least one frame for said driven belts with said common drive shaft being rotatably mounted therein; at least one eccentric cam being driven by a second stepper motor; at least one spring being connected between said at least one cam and said at least one frame; and a controller for actuating said second stepper motor to rotate said at least one cam in response to sheet media parameters and cause a spring force to be generated by said spring that selectively varies said pressure on said idler rollers and thus varies the frictional force of said driven belts.

In one aspect of the exemplary embodiment there is provided a series of parallel registration belts, each mounted in a continuous manner on a drive roller and an idler roller. All of the drive rollers are attached to a common rotatable drive shaft that is driven by a stepper motor at one end. The opposing outer most belts have a metal plate secured to the drive shaft with bearings to allow rotation of the drive shaft therein. The idler rollers have separate, coaxially aligned idler shafts with adjacent idler shafts being loosely interconnected. The outer most ends of the idler shafts are attached to the metal plates and the idler rollers are free to rotate relative to their idler shafts. The metal plates are connected together by the common drive shaft and the interconnected idler roller shafts to create a frame which surrounds the belts. The frame may be pivoted about the common drive shaft, so that the idler rollers are cantilevered in the frame from the common drive shaft. The loose interconnection between the idler shafts permit each belt to move a small amount relative to each other to accommodate contour variation in the stack of sheets in the registration system. The mass of the cantilevered idler rollers and frame provides the pressure on the belts traveling around the idler rollers to enable acquisition of the sheets as they enter the registration system from a sheet transport. A stepper motor and eccentric cam rotated thereby pivot the frame about the common drive shaft to automatically adjust the pressure being applied by the belts to the entering sheets. The actuation of the stepper motor to rotate the cam and adjust the pressure of the idler rollers is in response to sheet media parameters inputted into the control panel of the device incorporating the registration system by an end user.

In another aspect of the exemplary embodiment, there is provided a belt driven sheet registration system for a sheet handling device that provides a variable pressure to sheets arriving to be registered thereby, comprising: a plurality of individual belts, each belt entrained about a driven roller and an idler roller; said driven rollers being mounted on a common drive shaft; an electric motor being connected to one end of said common drive shaft; said idler rollers each having a shaft for rotation thereon, said idler roller shafts being coaxially aligned and parallel to said common drive shaft with adjacent idler roller shafts being loosely interconnected; a pair of parallel plates having distal ends and being positioned on a opposite sides of said plurality of belts, said pair of plates creating a frame to house said plurality of belts in cooperation with said common drive shaft and aligned and interconnected idler roller shafts, said common drive shaft being rotatably mounted in said pair of plates at one location and said aligned and interconnected idler roller shafts being attached to said distal ends of said pair of plates, so that said idler rollers are cantilevered about said common drive shaft; and an eccentric cam being connected to a stepper motor for bi-directional rotation thereby, said cam being connected to said frame by a spring, so that rotation of said cam generates a spring force to pivot said frame about said common drive shaft; rotation of said cam by said stepper motor in response to sheet media parameters entered into a control panel for said sheet handling device by an end user causing said frame to pivot and selectively vary pressure applied by said belts on said cantilevered idler rollers to sheets arriving at said sheet registration system, thus accommodating a broader range of sheet media without damage thereto.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
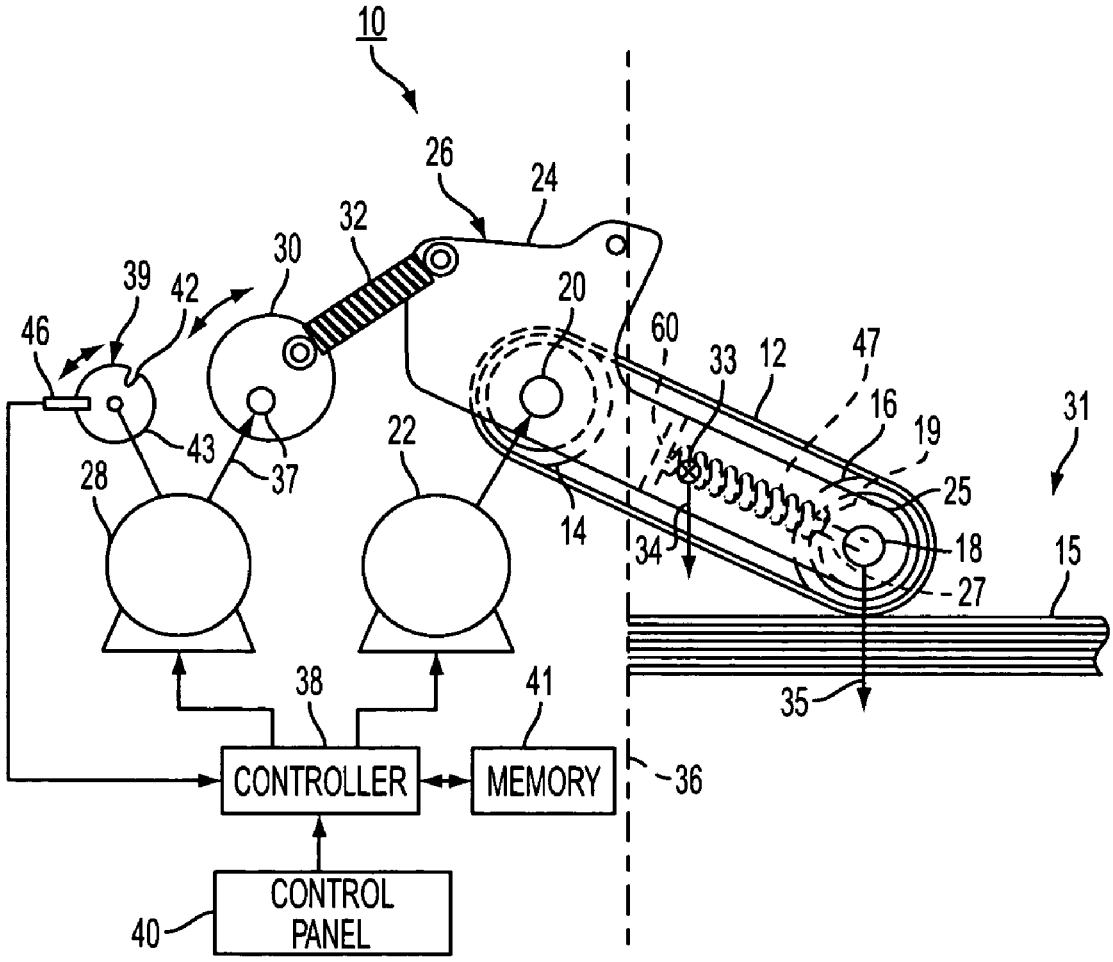
FIG. 1 is a schematic side elevation view of a variable pressure sheet registration system for a sheet handling device according to an exemplary embodiment of this application.
Figure 2:
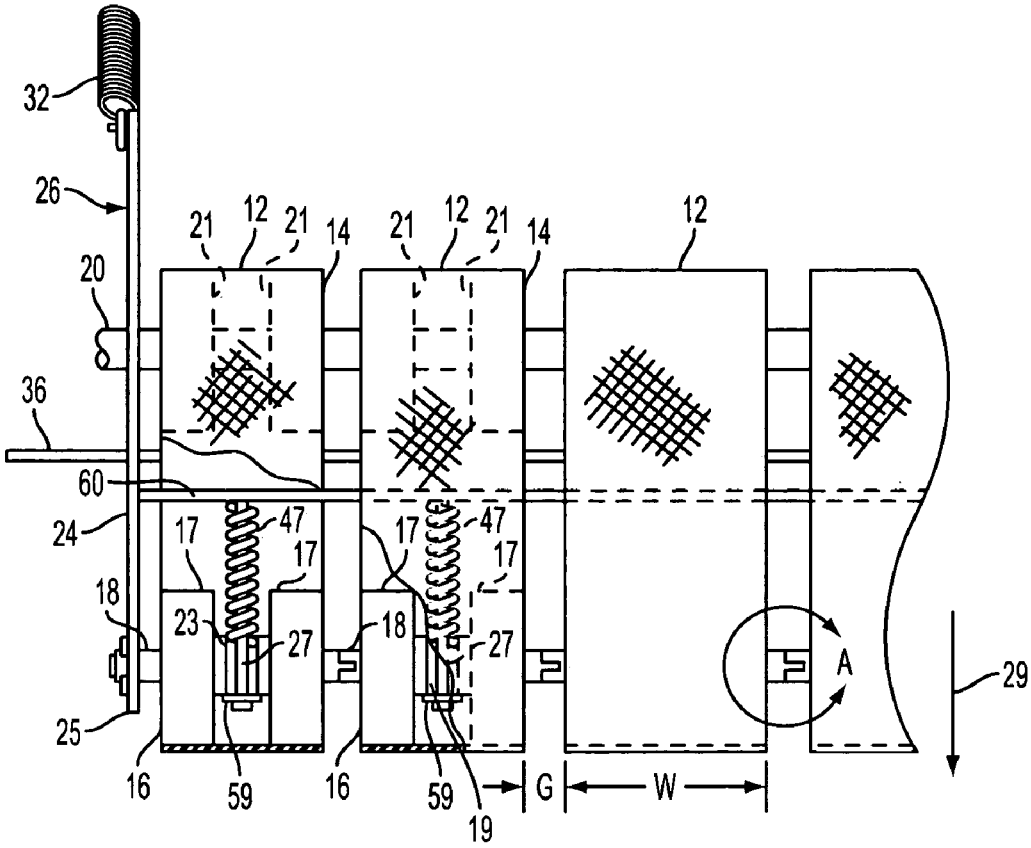
FIG. 2 is a partially shown and partially sectioned plan view of the sheet registration system shown in FIG. 1.

In FIG. 1, there is shown a schematic side elevation view of a variable pressure sheet registration system 10 for use in a sheet handling device (not shown), such as, for example, a finishing device. By way of example, a finishing device may be a typical sheet sorter and/or collator with stapling or binding capability. The finishing device may be coupled to a copier or printer (not shown) for finishing the sheets reproduced thereby or may be used as a stand-alone sheet finisher. Referring also to FIG. 2, where a partially shown and partially sectioned plan view of the sheet registration system is depicted, a plurality of parallel driven belts 12 of fixed width are arranged in a continuous manner across the depth of the sheet registration system. Each belt 12 is mounted on a driven roller 14 and an idler roller 16. The idler rollers comprise a pair of identical wheels 17 that are rotatably mounted on an individual shaft 18. The idler roller shaft 18 has a larger diameter portion 19 in the center thereof against which the pair of wheels 17 resides. To reduce wear and friction on the sides of the wheels 17, a bushing 71 may be provided between the outer surfaces of the larger diameter portion 19 of the idler shaft 18 and the wheels 17 (see FIG. 8). The driven rollers 14 may be either solid (not shown) or also consist of a pair of wheels 21, as shown. The driven rollers are attached to a common drive shaft 20 that is connected at one end to a stepper motor 22 for rotation thereby. The idler roller shafts 18 are coaxially aligned and substantially parallel to the common drive shaft 20. Adjacent idler roller shafts 18 are loosely interconnected.

A pair of parallel metal plates 24 having distal ends 25 is positioned on opposite sides of the plurality of driven belts 12. The pair of plates 24 creates a frame 26, in cooperation with the common drive shaft 20 and interconnected idler roller shafts 18, between which the driven belts 12 are supported. The spacing "G" between belts 12 is 2-5 mm and the width "W" of the belts 12 is about 42 mm. The common drive shaft 20 is rotatably mounted in the pair of plates 24 at a location spaced from the distal ends thereof. The opposing outermost idler roller shafts 18 are attached to the pair of plates 24 at the distal ends thereof, so that the idler rollers are cantilevered in the pair of plates about the common drive shaft. The driven belts 12 wrapped around the idler rollers 16 contact each incoming sheet 15 and register the incoming sheets against a registration wall 36 (shown in phantom line) and into a stack of sheets on a shelf (not shown) in the registration station 31.

A crossbar 60 is attached perpendicular to and between the pair of plates 24. The crossbar 60 is located between the driven rollers 14 and the idler rollers 16. The height of the crossbar is less than the diameter of the driven rollers and idler rollers, so that the crossbar is located between confronting spans of the driven belts 12. The enlarged center portion 19 of the idler shafts 18 has a cylindrical opening 23 therethrough as better shown in FIG. 8. A cylindrical shaft 27 is attached to the crossbar 60 at one end and the other free end extends through the cylindrical opening 23 in center portion 19 of idler shaft 18. A suitable fastener, such as, for example, a retaining ring 59, is mounted on the end of the cylindrical shaft 27 to lock the idler roller thereto. The cylindrical shaft 27 is inserted through a compression spring 47 prior to being installed in the opening 23 in the idler shaft 18. Thus, compression springs 47 place a spring force on each of the idler rollers 16 to keep the belts 12 tensioned between the driven rollers 14 and the idler rollers 16.

The plurality of belts provide a registration system that can accommodate custom sheet media sizes from 1 to 20 inches and any size in between. The belts 12 lack of discrete edges ensures that sheet edges defined by cross-process sheet dimension have nothing to interact with, where the process direction is indicated by arrow 29. The mass of the cantilevered frame 26 and idler rollers 16 generate a normal force or pressure, represented by arrow 35, on the belts traveling around the idler rollers 16. This normal force of the idler rollers on the belts 12 provide the required frictional or acquisition force for the belts that is necessary to guide frictionally the incoming sheets 15 arriving at the registration station. With the proper acquisition force, the belts position the incoming sheets seriatim against the registration wall 36, one on top of the other to form a registered stack of sheets 15 on a table or shelf (not shown).

A small stepper motor 28 is attached to a support member (not shown) of the sheet registration system 10 and is drivingly connected to an eccentric cam 30. One end of an extension spring 32 connects to the cam 30 and the other end of the extension spring is attached to the frame 26 formed from the pair of metal plates 24. The force of the spring 32 may oppose the cantilevered mass of the frame and idler rollers, as identified by the center of gravity 33 and direction of gravitational force is indicated by arrow 34. Thus, the normal force of the idler rollers 16, identified by arrow 35, is generated by the cantilevered mass of the frame 26 and idler rollers 16. The normal force 35 thus provides the necessary acquisition force by the belts 12 on the incoming sheets 15 to the registration station 31 from a sheet transport, such as, for example, a vacuum transport belt (not shown).

A home position indicator 39 is connected to the shaft 37 of stepper motor 28, represented by arrow 37, connecting the stepper motor 28 to the cam 30 and may be either a conventional notched disk optical sensor (as shown) or a typical rotary encoder (not shown). The home position indicator 39 indicates the amount or angle to and from a home or reference position, viz., notch 42 in disk 43, when the controller 38 applies step pulses to the stepper motor 28 to rotate the cam 30. In the home position, the cam 30 is positioned so that no spring force is generated to oppose the normal force 35 provided by the full weight of the cantilevered frame 24 and idler rollers 16. Thus, when the stepper motor 28 is at the home position (as sensed by optical sensor 46), the maximum normal force is applied to the belts 12. As explained later, step pulses from the controller 38 in response to data signals from the control panel 40 causes the stepper motor 28 to rotate the eccentric cam 30 the desired amount. Rotation of the stepper motor 28 from the home position, as monitored by the home position indicator 39, generates an opposing spring force to reduce selectively the normal force 35 and vary the frictional or acquisition force of the belts 12 on the incoming sheets 15. Accordingly, sheet media parameters entered into the control panel by an end user automatically vary the acquisition force or pressure of the driven belts 12. Actively varying the pressure applied by the driven belts of the sheet registration system in accordance with the sheet media parameters enables a broader range of sheet media to be registered without damage or marking.

Incremental locations around the profile of the cam 30 and around the disk 43 from notch 42 of the home position indicator 39 represent various desired spring forces of spring 32 that vary the normal forces of the idler rollers 16. Empirically determined data or algorithms are stored in a look up table placed in memory 41 associated with the controller 38 that represent the various predetermined spring forces. For each set of sheets or job to be registered and stacked by the sheet registration system 10, an end user or operator inputs the sheet media information into the control panel 40 of the sheet handling device (not shown). Sheet media information may be, for example, the sheet weight in grams per square meter ($g/m^2$), whether the sheets are coated or plain (not coated), as well as the number of sheets per set and number of sets.

In response to the sheet parameter information inputted into the control panel 40, a microprocessor (not shown) in the sheet handling device associated with the control panel 40 generates a specific value for each sheet in the set or job and directs that value to the controller 38. Each value received by the controller 38 represents a desired opposing spring force to be applied to the frame 24 in order to reduce and vary the pressure or normal force 35 of the idler rollers 16. Hence, the driven belts traveling around the idler rollers will apply reduced pressure or varied frictional force on the incoming sheets 15 in direct relationship to the change of the normal force 35 of the idler rollers.

The controller 38 compares the values received from the microprocessor with the values stored in the look up table in memory 41 that represent empirically determined algorithms also stored in memory 41. Each algorithm provides stepper motor instructions for the appropriate spring force that will vary the pressure of the belts 12 on the incoming sheets and prevent damage or marking on the sheets to be registered. The controller 38 selects the algorithm having the value matched by the value received from the microprocessor. The selected algorithm energizes the stepper motor 28 and rotates the cam 30 the precise angular amount from the home position, as identified by the home position indicator 39, to achieve the desired normal force for the idler rollers 12. A different normal force algorithm may be selected for each sheet in each set of sheets by the controller 38.

Accordingly, the sheet media parameters for each sheet in each set of sheets may be entered into the control panel 40 of the sheet handling device. Therefore, each sheet of the set of sheets to be registered may have a different normal force for the idler rollers 16. A different algorithm may be used for each sheet to rotate automatically the cam 30 to a specific location from the home position and automatically vary the normal force of the idler rollers 16. This automatic changing of the normal force of the idler rollers prevents sheet damage or marking even when the sheet media of each sheet in a set of sheets varies from thick to thin sheets or coated to uncoated sheets. Accordingly, the exemplary embodiment of this application provides the ability of the sheet registration system to actively control the pressure of the idler rollers in real time and accommodate a wider range of sheet media automatically without marking any of the sheets.

Figure 3:
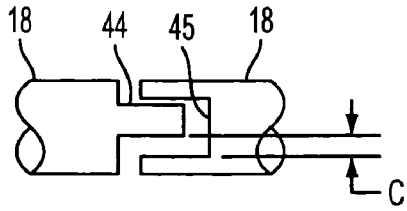
FIG. 3 is an enlarged view of the interconnection of two adjacent shafts of the idler rollers as identified by circled area "A" in FIG. 2.

In FIG. 3, an enlarged view is shown of the interconnection of two idler roller shafts 18 as identified by the circled area "A" in FIG. 2. The interconnection uses a tongue 44 and groove 45 type interlocking connection with a small clearance "C" of about 0.5 to 1 mm to allow some relative movement flexibility as set contour varies. This ensures good contact of the belts with the incoming sheet to be registered.

Figure 4:
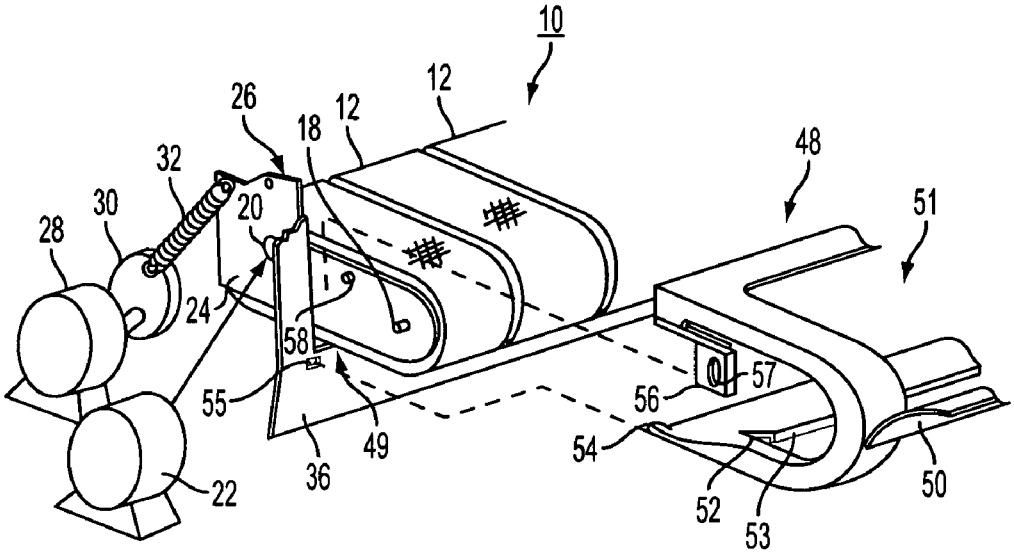
FIG. 4 is a partially shown isometric view of the sheet registration system of FIG. 1 with the addition of a cage having sheet guides shown spaced therefrom.
Figure 5:
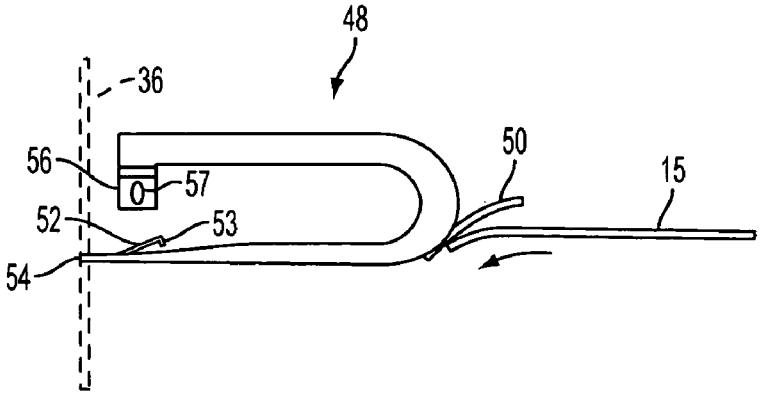
FIG. 5 is a side elevation view of the cage shown in FIG. 4.

The sheet registration system 10 includes a single piece cage 48 that is partially shown in isometric view in FIG. 4. The cage 48 is shown spaced from the driven belts 12 in frame 26 and registration wall 36 for clarity and ease of description. Referring also to FIG. 5, showing the cage 48 in side elevation view, the cage 48 has an upper sheet guide 50 across the width of the sheet registration system 10. The upper guide 50 directs the leading edge of the incoming sheets 15 from a sheet transport (not shown) such as, for example, a vacuum transport belt, into the stack of sheets in a direction tangent to the belts 12. The cage 48 also has a lower sheet guide 52 that extends outwardly from the registration wall 36 and bent upwardly towards the belts 12 with a lip 53 on its distal end. The lower sheet guide 52 extends the full width of the plurality of belts 12 and frame 26 and functions to strip the lead edge of the incoming sheets from the belts 12 as the belts position and register them against the registration wall 36. The lip 53 of the lower sheet guide 52 acts as a barrier to the sheet being registered and prevents the sheets from moving past the registration wall 36 and through the gap 49 between the belts 12 and registration wall.

The single piece cage 48 may be constructed of a molded resin or a thin gauge stainless steel. It surrounds the portion of the belts 12 and frame 26 that extend past the registration wall 36 and have a large opening 51 to allow the belts to protrude through it. Tabs 54 on opposite sides of the cage 48 are located on the bottom side of the cage adjacent to the lower sheet guide 52 and are inserted into apertures 55 in the registration wall. The tabs 54 loosely hold and position the cage 48 against the registration wall. The cage is attached to each of the pair of metal plates 24 at its upper side by two spring like arms 56 with slots 57 therein that are formed on opposite sides of the cage. The slots 57 engage studs 58 on the pair of metal plates 24 and the spring like arms grip the pair of metal plates and hold the cage 48 firmly in place against the frame 26. The cage is thus held in proper relationship with the plurality of driven belts 12 and allows the plurality of driven belts to protrude through the cage opening 51, so the cage 48 does not interfere with the incoming sheets. The upper sheet guide 50 of the cage 48 ensures reliable handoff of the incoming sheets from the sheet transport to the sheet registration system. The lower sheet guide 52 of the cage 48 assists in stripping the sheets from belts 12 and prevents the sheets being registered against the registration wall from moving through the gap 49 that exists between the registration wall 36 and plurality of driven belts 12.

Figure 6:
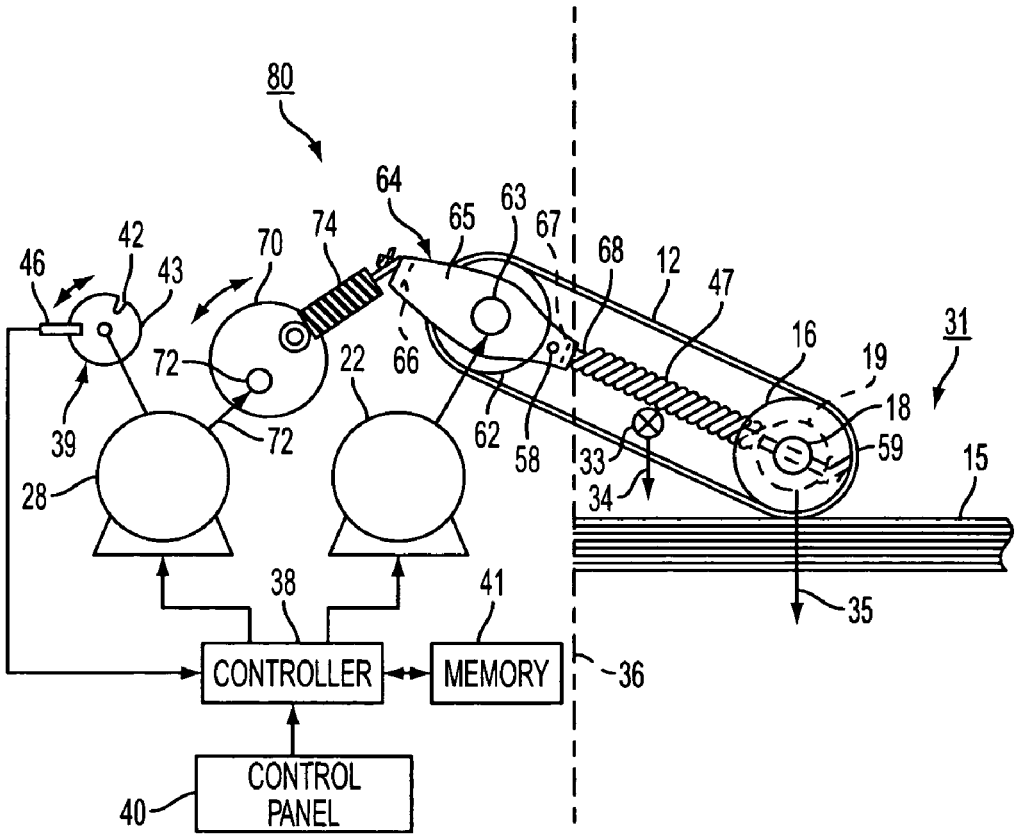
FIG. 6 is a schematic side elevation view of an alternate embodiment of variable pressure sheet registration system shown in FIG. 1.

An alternate embodiment 80 of the variable pressure sheet registration system of this application is shown in a schematic side elevation view in FIG. 6. As in the embodiment 10 shown in FIGS. 1 and 2, this embodiment 80 also has a plurality of parallel driven belts 12 of fixed width and arranged in a continuous manner across the depth of the sheet registration system. Each belt 12 is mounted on a crowned driven roller 62 and an idler roller 16 that is identical to the idler roller in embodiment 10. The crowned driven rollers 62 have an arcuate or convex outer surface to assist in keeping the belts 12 centered thereon. Each of the driven rollers 62 are attached to a common drive shaft 63 by a pin 73 to prevent relative rotation therebetween. The common drive shaft 63 is connected at one end to a stepper motor 22 for rotation thereby. The idler shafts 18 in this embodiment 80 are identical to the idler shafts 18 in the embodiment 10, so that a detailed description need not be repeated. Suffice to say that the idler shafts are coaxially aligned and substantially parallel to the common drive shaft 63, with adjacent idler shafts being loosely interconnected as shown in FIG. 3.

The common drive shaft 63 is rotatably mounted in a plurality of identical rectangular support structures 64, one support structure for each belt 12. The support structures 64 are arranged side-by-side with a small space therebetween. Each support structure 64 has a pair of parallel side panels 65 through which the common drive shaft 63 is rotatably mounted in bearings 61 for rotation therein. All of the side panels 65 are parallel to each other. Parallel structural beams 66, 67 on opposite ends of the side panels 65 complete each of the support structures 64. Structural beam 67 confronts the idler rollers 16 and has a cylindrical shaft 68 attached at one end thereto. The other free end of the cylindrical shaft 68 extends through the opening 23 (see FIG. 8) in the enlarged central portion 19 of idler shaft 18. The free end of the cylindrical shaft 68 protrudes through the opening 23 in idler shaft 18 and a suitable fastener, such as a retaining ring 59 is fastened thereto in order to lock the idler shaft and thus the idler roller 16 to the support structure 64. A compression spring 47 through which the cylindrical shaft 68 resides applies a spring force between the structural beam 67 of the support structure 64 and the idler roller 16 to provide the appropriate tension of the belt 12.

A circular tab 69 extends perpendicularly from each structural beam 66 of the support structure 64 in a direction away from the driven roller 62. An identical eccentric cam 70, one for each belt 12, is attached to a common cam shaft 72. One end of the common cam shaft 72 is connected to stepper motor 28 for rotation thereby. A tension spring 74 interconnects each cam with a respective one of the circular tabs 69. Thus, rotation of the common cam shaft 72 by stepper motor 28 causes a spring force to be generated by each tension spring 74 that pivots each of the support structures 64. The concurrent pivoting of each of the separate support structures 64 reduces the gravitational force on the idler rollers cantilevered about the common drive shaft 63 and varies the normal pressure of the idler rollers against incoming sheets to be registered in a manner very similar to the way the normal pressure is varied in the embodiment 10 of this application. The main difference between embodiment 80 and embodiment 10 is that the belts 12 in alternate embodiment 80 have separate support structures 64, separate cams 70, and separate tension springs 74, while the embodiment 10 shown in FIGS. 1 and 2 have one frame 26 surrounding all belts 12 with one cam 30 interconnected to the frame by one spring 32.

The opposing outer most side panels 65 of the outer most support structure 64 have studs 58 and the registration wall 36 has apertures 55 to provide the means to install the cage 48 shown in FIGS. 4 and 5. Thus, the cage 48 with its upper and lower guides 50, 52 functions the same way for the embodiment 80 as it does with the embodiment 10 shown in FIGS. 1 and 2 and described with reference to FIGS. 4 and 5.

Figure 7:
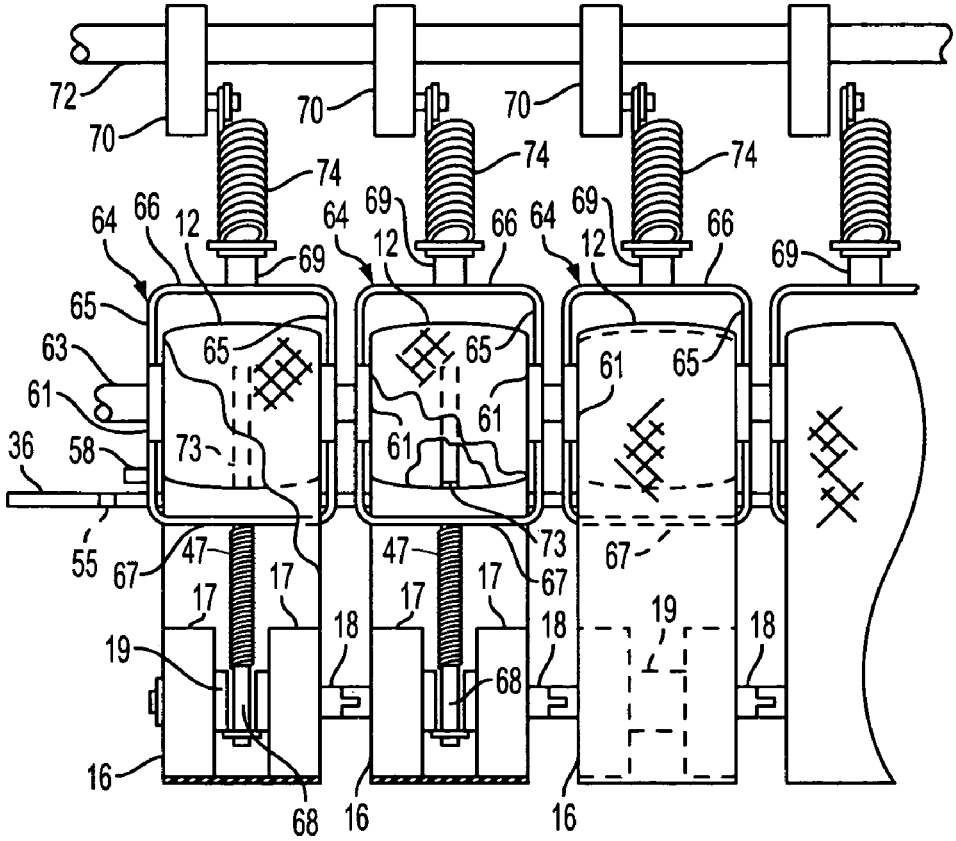
FIG. 7 is a partially shown and partially sectioned plan view of the alternate embodiment shown in FIG. 6.

The operation of the embodiment 80 shown in FIGS. 6 and 7 is substantially identical to the operation of the embodiment 10 shown in FIGS. 1 and 2 as described earlier. Therefore, a detailed operation of embodiment 80 is not necessary as it would be only a repeat of the previous description of the operation of embodiment 10. Accordingly, a summary of the operation of embodiment 80 will suffice as follows. An end user inputs sheet parameter data for the set or job to be finished into the control panel 40 of the sheet handling device incorporating the variable pressure sheet registration system 80 of this application. A microprocessor (not shown) associated with the control panel sends generates a specific value for each sheet in the set or job and directs that value to the controller 38. The controller 38 compares the values received from the microprocessor with values stored in the look up table in memory 41. Each of the values stored in the look up table in memory 41 represent algorithms that instruct stepper motor 28 to rotate cam shaft 72 a predetermined amount. Rotation of the cam shaft 72 rotates each of the plurality of cams 70 and produces a desired spring force in each of the springs 74. The spring force generated by the springs 74 adjusts or varies the normal pressure of the idler rollers 16 by pivoting of the support structures 64 and reducing the gravitational force indicated by arrow 34. The reduced gravitational force varies the normal pressure applied by the idler rollers 16 and thus the frictional or acquiring force of the belts 12.

Hence, sheet media parameters inputted into the control panel 40 by an end user determine the algorithm selected by the controller 38. The selected algorithm instructs the stepper motor 28 to rotate the bank of cams 70 on the common cam shaft 72 a precise angular amount from a home or reference position to achieve the desired normal pressure for the idler rollers 16. Thus, a different normal force algorithm may be selected for each sheet in each set of sheets by the controller 38. The stepper motor 22, under control of the controller 38, drives the crowned drive rollers 62 to move the belts 12. The normal pressure applied by the idler rollers 16 is directly related to the gravitational force, as adjusted, and provides the belts 12 with the desired frictional force. The frictional force of each of the belts 12 enable the belts to acquire the incoming sheet 15 that tangentially approach the belts from a sheet transport (not shown). The belts 12 then register each incoming sheet against registration wall 36 with the assistance of the upper and lower guides 50, 52, respectively, on cage 48. The ability of the variable pressure sheet registration system 10 or 80 to automatically change the normal force of the idler rollers 16 prevents sheet damage or marking even when the sheet media of each sheet in a set of sheets varies from thick to thin sheets or coated to uncoated sheets.

Figure 8:
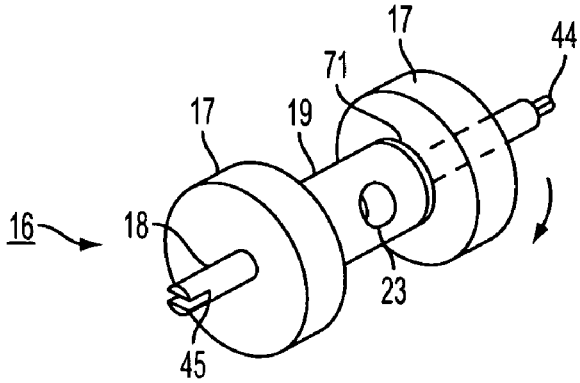
FIG. 8 is an isometric view of one of the idler rollers used in the variable pressure sheet registration system of this application.

In FIG. 8, an isometric view of one of the idler rollers 16 is shown. The idler roller 16 comprises an idler shaft 18 having an enlarged center portion 19 with the pair of wheels 17 positioned against bushings 71 (only one shown) on the outer surfaces of the center portion 19. The bushings prevent wear and reduce friction between the wheels 17 and the center portion 19 as the wheels rotate about the idler shaft 18. The center portion 19 of each idler shaft 18 has the opening 23 through which the circular shafts 68 extend as described earlier. The idler shaft 18 has a tongue 44 on one end and a groove 45 on the other end for the flexible interconnection between adjacent idler shafts as shown in FIG. 3.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A variable pressure, belt-driven sheet registration system for use in a sheet handling device, comprising:

a series of parallel driven belts, each belt being mounted on a drive roller and an idler roller, said drive rollers being fixedly mounted on a common drive shaft for rotation thereby, said idler rollers being rotatably mounted on separate idler shafts that are coaxially aligned and parallel to said common drive shaft, adjacent idler shafts being flexibly interconnected;

said idler rollers and driven belts thereon being cantilevered from and pivoted about said common drive shaft, so that a gravitational force on said idler rollers provides a normal pressure on said driven belts that contact incoming sheets to be registered thereby, thus generating a frictional force by said driven belts to enable said driven belts to register said incoming sheets against a registration wall;

a first stepper motor being connected to said common drive shaft for rotation thereof;

at least one frame for said driven belts with said common drive shaft being rotatably mounted therein;

at least one eccentric cam being attached to a cam shaft and said cam shaft being driven by a second stepper motor for rotation of said at least one eccentric cam;

at least one spring being connected between said at least one cam and said at least one frame; and a controller for actuating said second stepper motor to rotate said at least one cam in response to sheet media parameters and cause a spring force to be generated by said at least one spring that selectively varies said normal pressure on said idler rollers and thus varies the frictional force of said driven belts.

2. The sheet registration system as claimed in claim 1, wherein said at least one frame is a pair of plates having distal ends, said pair of plates being positioned on opposite sides of said series of driven parallel belts;

wherein said common drive shaft is rotatably mounted in said pair of plates at a location spaced from said distal ends thereof; and wherein said opposing outermost idler shafts are attached to said pair of plates at said distal ends thereof, so that said idler rollers and said idler shafts are cantilevered in said frame about said common drive shaft.

3. The sheet registration system as claimed in claim 2, wherein said cantilevered idler rollers, idler shafts, and pair of plates have a mass and gravity acting upon said mass provides normal force of said idler rollers and generates said frictional force of said driven belts for acquiring said incoming sheets; and wherein said incoming sheets tangentially contact said driven belts at a location on said driven belts that is on a lower side of said idler rollers.

4. The sheet registration system as claimed in claim 3, the sheet registration system further comprising:

a home position indicator connected to said cam shaft, said home position indicator having a home position representing maximum normal force for said idler rollers, so that upon rotation of said cam shaft by said second stepper motor, said home position indicator indicates an amount of angular movement by said cam from said home position; and incremental locations around said cam from said home position being representative of various desired spring forces generated by said at least one spring that reduces and thus varies said normal force of said idler rollers on said driven belts.

5. The sheet registration system as claimed in claim 4, further comprising:

a memory having a lookup table containing a plurality of algorithms, each algorithm instructing said second stepper motor to rotate said cam a predetermined angular amount from said home position to generate a specific spring force in said at least one spring to vary said normal force of said idler rollers;

a control panel for use by an end user to input said sheet media parameters, said control panel generating a value for each sheet to be registered in response to said sheet media parameters inputted by said end user and directing said values to said controller; and said controller, in response to receiving said values from said control panel, selecting an algorithm from said lookup table in said memory and instructing said second stepper motor to rotate said cam a predetermined angular amount from said home position, thereby automatically varying said normal force of said idler rollers.

6. The sheet registration system as claimed in claim 5, further comprising:

said registration wall being spaced below and extending across said series of driven belts and being located between said drive rollers and said idler rollers, said registration wall being substantially perpendicular to said pair of plates and being spaced from said driven belts to provide a clearance gap therebetween; and a cage surrounding portions of said driven belts and said pair of plates that extend past said registration wall, said cage having an opening to allow said driven belts entrained about said idler rollers to protrude therethrough.

7. The sheet registration system as claimed in claim 6, wherein said cage further comprises:

an upper sheet guide extending across said series of driven belts for directing leading edges of said incoming sheets into tangential contact with said driven belts; and a lower sheet guide extending across said series of driven belts and being substantially parallel to said upper sheet guide for stripping said leading edge of said incoming sheets from said driven belts.

8. The sheet registration system as claimed in claim 7, wherein said cage is removably attached to said pair of plates by a spring-like arm with slots therein formed on opposing sides of said cage and a pair of studs, one stud of said pair of studs being attached to each of said pair of plates, said studs being engaged into respective slots of said spring-like arms; and wherein tabular extensions on opposite sides of said cage are inserted into apertures in said registration wall to hold said cage in position relative to registration wall and said pair of plates.

9. The sheet registration system as claimed in claim 8, wherein said lower sheet guide of said cage extends outwardly in a direction from said registration wall and has a distal edge with a lip thereon, said lip acting as a barrier to said incoming sheets and preventing said incoming sheets from moving through said gap between said registration wall and said series of driven belts.

10. The sheet registration system as claimed in claim 1, wherein said drive rollers have a crowned outer surface to assist in keeping said driven belts centered thereon;

wherein said at least one frame is a plurality of support structures, one for each driven belt, each of said support structures having a pair of parallel side panels and a structural beam attached to opposite ends of said side panels, so that each of said support structures surrounds a one of said drive rollers with said common drive shaft being rotatably mounted in each of said side panels of each of said support structures, said structural beams of each support structure being parallel to each other and each of said pairs of side panels of said support structures being parallel to each other; and wherein a one of said structural beams is located between parallel spans of each of said driven belts and at a location intermediate said drive rollers and said idler rollers with said intermediately located structural beam confronting said idler rollers.

11. The sheet registration system as claimed in claim 10, wherein each of said idler rollers are a pair of spaced wheels rotatably mounted on said idler shafts;

wherein each of said idler shafts have an enlarged central portion which separates said pair of wheels, said enlarged central portions of said idler shafts having an opening therethrough;

wherein a cylindrical shaft for each driven belt has opposing ends, one end of said cylindrical shafts being attached to said structural beams of said support structures that confronts said idler rollers and the other end extending through said opening in said enlarged central portion of said idler shaft, said ends of said cylindrical shafts that extend through said openings in said enlarged central portions of said idler shafts having a fastener attached thereto to lock said idler rollers to said support structures; and wherein a compression spring is mounted on each of said cylindrical shafts to provide tension on each of said driven belts.

12. The sheet registration system as claimed in claim 11, wherein a tab extends perpendicularly from each structural beam of said support structures opposite said structural beam having said cylindrical shaft attached thereto, said tabs extending in a direction away from said drive rollers;

wherein said at least one eccentric cam is a plurality of identical eccentric cams, each eccentric cam being commonly attached to said cam shaft that is driven by said second stepper motor; and wherein said at least one spring is a plurality of springs, one spring being connected between a respective one of said plurality of eccentric cams and a one of said tabs on said structural beams of said support structures.

13. The sheet registration system as claimed in claim 12, wherein each of said support structures and respective idler roller and associated idler shaft are cantilevered from and pivotable about said common drive shaft, each of said cantilevered support structures with idler rollers and idler shafts attached thereto have a combined mass upon which gravity acts to provide normal force on each respective one of said idler rollers; and wherein said incoming sheets tangentially contact said driven belts on an under side of said idler rollers, so that said gravity generated normal force produces said frictional force of said driven belts and enables registration of said incoming sheets against said wall.

14. The sheet registration system as claimed in claim 13 and further comprising:

a home position indicator connected to said cam shaft, said home position indicator having a home position representing maximum normal force for said idler rollers, so that upon rotation of said common cam shaft by said second stepper motor, said home position indicator indicates an amount of angular movement by said cams from said home position; and incremental locations around said cams from said home position being representative of various desired spring forces generated by each of said springs that reduces and thus varies said normal force of each of said idler rollers on said respective driven belts.

15. The sheet registration system as claimed in claim 14 and further comprising:

a memory having a lookup table containing a plurality of algorithms, each algorithm providing instructions for said second stepper motor to rotate said cams a predetermined angular amount from said home position to generate a specific spring force in each of said springs to vary said normal force of each of said idler rollers;

a control panel for use by an end user to input said sheet media parameters, said control panel generating a value for each sheet to be registered in response to said sheet media parameters inputted by said end user and directing said values to said controller; and said controller, in response to receiving said values from said control panel, selecting an algorithm from said lookup table in said memory and instructing said second stepper motor in accordance with said selected algorithm to rotate said cam shaft and therefore said cams thereon a predetermined angular amount from said home position, thereby automatically varying said normal force of each of said idler rollers.

16. The sheet registration system as claimed in claim 15 and further comprising:

said registration wall being spaced below and extending across said series of driven belts and being located between said drive rollers and said idler rollers, said registration wall being substantially perpendicular to said pairs of side panels of each of said support structures and being spaced from said driven belts to provide a clearance gap therebetween; and a cage surrounding portions of said driven belts that extend past said registration wall, said cage having an opening to allow said driven belts entrained about said idler rollers to protrude therethrough.

17. The sheet registration system as claimed in claim 16 and further comprising:

an upper sheet guide on said cage extending across said series of driven belts for directing leading edges of said incoming sheets into tangential contact with said driven belts; and a lower sheet guide on said cage extending across said series of driven belts and being substantially parallel to said upper sheet guide for stripping said leading edge of said incoming sheets from said driven belts.

18. The sheet registration system as claimed in claim 17, wherein said cage is removably attached to said outermost side panels of said outermost support structures by a spring-like arm with slots therein formed on opposing sides of said cage and a pair of studs, one stud of said pair of studs being attached to each of said outermost side panels, said studs being engaged into respective slots of said spring-like arms;

wherein tabular extensions on opposite sides of said cage are inserted into apertures in said registration wall to hold said cage in position relative to registration wall and said outermost side panels of said outermost support structures; and wherein said lower sheet guide of said cage extends outwardly in a direction from said registration wall and has a distal edge with a lip thereon, said lip acting as a barrier to said incoming sheets and preventing said incoming sheets from moving through said gap between said registration wall and said series of driven belts.

* * * * *